US007284394B2

(12) United States Patent
Heyl et al.

(10) Patent No.: US 7,284,394 B2
(45) Date of Patent: Oct. 23, 2007

(54) INNER HEAT EXCHANGER FOR HIGH-PRESSURE REFRIGERANT WITH ACCUMULATOR

(75) Inventors: Peter Heyl, Köln (DE); Joern Froehling, Cologne (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 455 days.

(21) Appl. No.: 10/961,797

(22) Filed: Oct. 8, 2004

(65) Prior Publication Data

US 2005/0103046 A1 May 19, 2005

(30) Foreign Application Priority Data

Oct. 9, 2003 (DE) ..... 103 48 141

(51) Int. Cl.
*F25N 43/00* (2006.01)

(52) U.S. Cl. ..... 62/503

(58) Field of Classification Search ..... 62/503, 62/513, 113, 1

See application file for complete search history.

(56) References Cited

U.S. PATENT DOCUMENTS

| | | | | |
|---|---|---|---|---|
| 3,721,104 | A | 3/1973 | Adler | |
| 4,078,604 | A | 3/1978 | Christl et al. | |
| 4,217,765 | A | 8/1980 | Ecker | |
| 4,285,779 | A | 8/1981 | Shiga et al. | |
| 4,552,724 | A | 11/1985 | Matsumoto et al. | |
| 4,653,282 | A | 3/1987 | Gueneau | |
| 6,092,590 | A | 7/2000 | Suttrop | |
| 6,253,572 | B1 | 7/2001 | Bottum, Sr. et al. | |
| 6,463,757 | B1 | 10/2002 | Dickson et al. | |
| 6,523,365 | B2 | 2/2003 | Zhang et al. | |
| 6,722,155 | B2 * | 4/2004 | Fisk et al. | 62/503 |
| 2003/0024266 | A1 * | 2/2003 | Zhang et al. | 62/503 |

* cited by examiner

*Primary Examiner*—Melvin Jones
(74) *Attorney, Agent, or Firm*—Brinks Hofer Gilson & Lione

(57) ABSTRACT

The invention relates to an inner heat exchanger for high-pressure refrigerants which is also used as an accumulator or refrigerant collector in air conditioning circuits. The inner heat exchanger includes an outer cylinder arranged and an inner cylinder arranged therein. The inner cylinder is designed as a bent flat sheet or tube with microchannels for refrigerant under high pressure. The liquid refrigerant under low pressure is collectable within the inner cylinder. Between inner cylinder and outer cylinder are formed channels in which the vaporous refrigerant under low pressure flows from a low-pressure inlet to a low-pressure outlet.

14 Claims, 4 Drawing Sheets

INNER HEAT EXCHANGER FOR HIGH-PRESSURE REFRIGERANT WITH ACCUMULATOR

BACKGROUND

1. Field of the Invention

The invention relates to an inner heat exchanger for high-pressure refrigerant which is also used as an accumulator or refrigerant collector in an air conditioning circuit. Particularly the inner heat exchanger is used with high-pressure refrigerants such as carbon dioxide or R 134a.

2. Related Technology

Inner heat exchangers are used to enhance the efficiency of air conditioning circuits and are also known as countercurrent supercoolers. By cooling or supercooling the high-pressure flow and superheating the refrigerant vapor, they increase the refrigerating capacity and, therefore, the efficiency of the refrigeration process, which particularly improves the specific refrigeration capacity.

In the state-of-the-art, varied combinations of inner heat exchangers and accumulators are known. In U.S. Pat. No. 4,217,765, for example, an inner heat exchanger and accumulator is disclosed whereby the refrigerant under low pressure collects in the space between a heat exchanger coil and an outer cylinder surface and cools the heat exchanger coil.

From DE 199 03 833 A1 an integrated collector-heat exchanger unit is known that functions as inner heat exchanger and collector/accumulator. The heat exchanger coil used has a helical shape and is in heat contact with the collector space. Also a collector-heat exchanger unit is disclosed that combines a helical coaxial heat exchanger in a collector for the refrigerant.

In DE 14 51 001 a process and a device for the operation of a refrigeration process are disclosed whereby superheating of the refrigerant vapor, with simultaneous supercooling of the high-pressure flow, is taught reflecting the principle of supercooling countercurrent. The heat exchanger and collector disclosed includes various helical tube packages arranged coaxially.

From DE 31 19 440 A1 a plant heat exchanger for refrigeration plants is known that enables a compact structure for the combined heat exchanger and collector function.

All heat exchangers and collectors/accumulators mentioned above have the common disadvantage of not being suitable for use with high-pressure refrigerants. One reason is that the cross-sections of the refrigerant lines are too large. Because of the high pressures in such refrigeration plants, different design principles needed.

This disadvantage is partly overcome by a heat exchanger accumulator shown in U.S. Pat. No. 6,523,365. In U.S. Pat. No. 6,523,365 a device is disclosed that can also be particularly used for high-pressure refrigerants and, to this end, contains microchannels for the high-pressure refrigerant. The flat tubes with the microchannels for the high-pressure refrigerant at high-pressure are arranged helically as a bundle in the upper part of the refrigerant collector/accumulator and are cooled by the refrigerant vapor in the upper part of the case. The refrigerant vapor is led countercurrently in microchannels for the refrigerant vapor, which are arranged parallel to the microchannels for the refrigerant under high pressure.

The heat exchanger/accumulator can partly overcome the disadvantages of the above mentioned state-of-the-art by that the high-pressure refrigerant flow is passed over a heat exchanger coil with microchannels for the high-pressure refrigerant flow. This allows the transfer of heat to refrigerants also at very high pressures. Over the different layers of microchannels, the heat is dissipated to the refrigerant vapor parallel led countercurrently.

The state-of-the-art is still disadvantageous in that heat transfer, however, can only take place in the upper part of the heat exchanger and over a smaller heat transfer surface. Also there are very high flow losses of the refrigerant vapor in the microchannels.

Therefore it is the aim of this invention to provide an inner heat exchanger with accumulator that is suitable for high-pressure refrigerants and is capable of efficiently solving the heat transfer problem. Further, it is intended to realize a simple design solution for the integration of the collector, or accumulator, respectively.

SUMMARY

The problem contemplated by the invention is solved by an inner heat exchanger for high-pressure refrigerant with an accumulator, which includes a vertically arranged outer cylinder having an inner cylinder arranged therein. The inner cylinder is designed as flat sheet or tube with microchannels formed therein for the refrigerant under high pressure. Between the inner cylinder and the outer cylinder, channels are provided for the vaporous refrigerant under the low pressure to flow from top to bottom, from the low-pressure inlet to the low-pressure outlet. The liquid refrigerant under low pressure is collected in the interior region formed by the inner cylinder.

According to a preferred embodiment of the invention, the channels between the inner cylinder and the outer cylinder are formed by spacers. The channels may be created by the spacers being formed as an integral or unitary part of the flat tube. Alternatively, the spacers may be provided as an integral or unitary part of the outer cylinder.

According to a first advantageous embodiment of the invention, the spacers are formed parallel to each other along the generatrix of the inner cylinder and the outer cylinder. To prolong the residence time of the refrigerant vapor in the inner heat exchanger, the spacers are formed such that they can run helically between the circumferential surfaces of the outer and/or inner cylinders. The manufacture of the spacers in either construction can be advantageously realized by extrusion molding then manufacturing the inner or outer cylinder.

The flat tube having the microchannels, which forms the inner cylinder, is arranged in the inner heat exchanger such that the microchannels run transverse to the cylinder axis of the inner and out cylinders. This makes possible to realize cross countercurrent or cross co-current flow. Particularly preferably, the cross countercurrent flow principle is used in the inner heat exchanger.

According to another advantageous embodiment of the invention, a cover is provided to close the outer cylinder at the top. The cover is provided with a low-pressure inlet and is penetrated by a high-pressure inlet and a high-pressure outlet. The cover is provided with a groove, defined within an extension, whereby a positive connection of the outer cylinder and the cover can be produced when the outer cylinder is dosed. The cover may further be connected to the outer cylinder by a welding connection.

Due to the combination of a flat tube with microchannels as inner cylinder and spacers to an outer cylinder, an inner heat exchanger can be created that can economically and advantageously be produced in industry. Forming the spacers as unitary parts further reduces the production and manufacture effort so that inner heat exchangers of the invention are characterized by low costs. The problems caused by the high pressures going back to the refrigerant are advantageously solved in that the microchannels in the inner cylinder are provided with a high-pressure inlet and a high-pressure outlet in the interior of the inner cylinder and leave the inner heat exchanger/accumulator over a sealed lead-through in the cover in an economically favorable, simple design.

Further, it is advantageous that the low pressure inlet for the refrigerant, as well as the high-pressure inlet (the cover) and the high-pressure outlet, are formed within one component (the cover) and sealed, and that only the low pressure outlet at the lower end of the cylindrical refrigerant collector is, preferably, welded and hence pressure-tight, arranged separate. According to an alternative embodiment of the invention, the low-pressure outlet could also be provided in the cover so that no connections are located in the outer cylinder.

BRIEF DESCRIPTION OF THE DRAWINGS

Further advantages and features of the invention follow from the drawings in which.

DETAILED DESCRIPTION OF THE INVENTION

Figure 1:
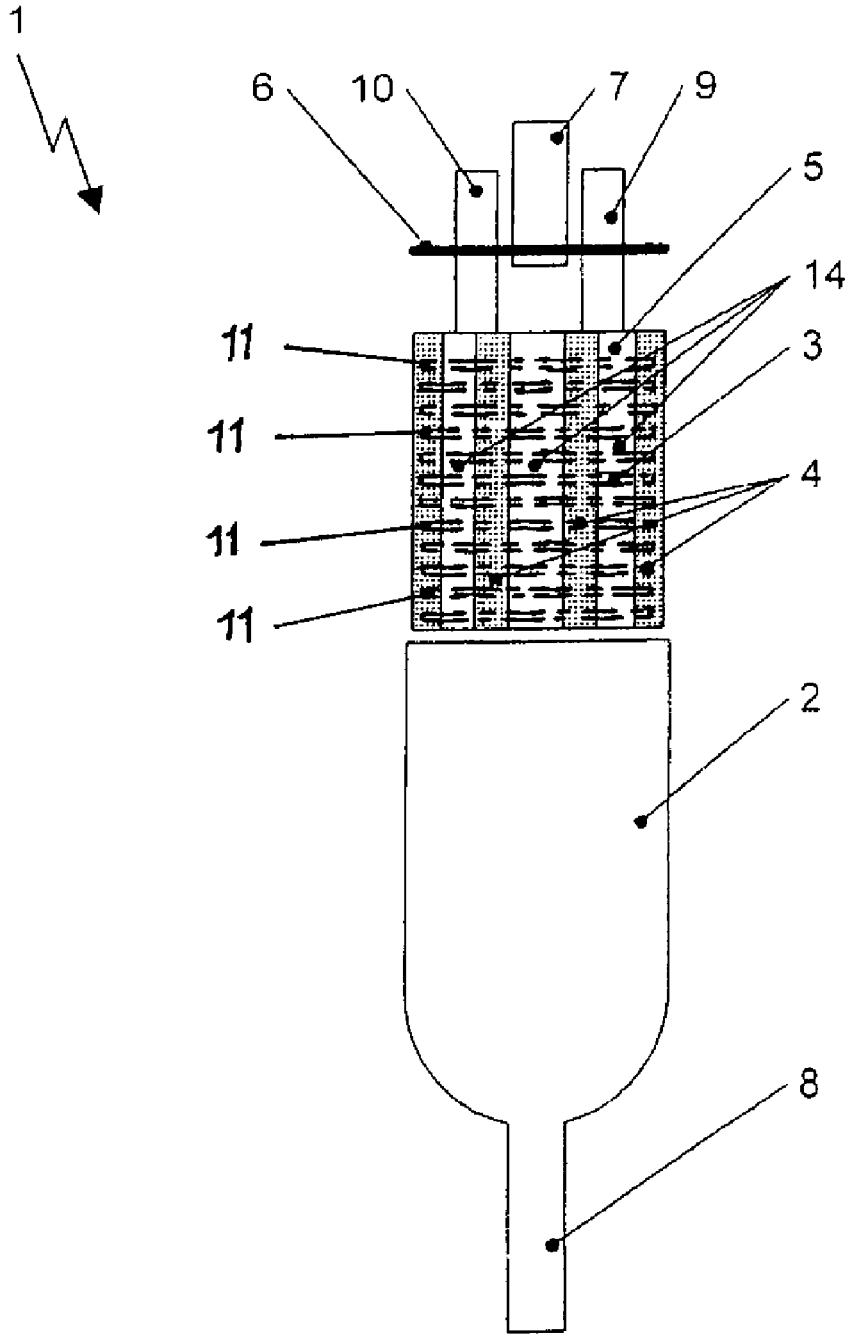
FIG. 1 shows an exploded view of the inner heat exchanger and accumulator, according to the principles of the present invention.

In FIG. 1 an inner heat exchanger with accumulator 1 according to the present invention, is shown. The figure shows the inner heat exchanger/accumulator 1 with an outer cylinder 2, which tapers at its lower end and terminates in a low-pressure outlet 8. The inner cylinder 3 is shown pulled out of the outer cylinder 2 and includes a flat sheet tube 5 which is provided with microchannels 11 therein for the high-pressure refrigerant. The flat tube 5 is designed such that the microchannels 11 running in the flat tube 5 form a circular arc on the cylinder axis and appear transverse to the cylinder axis in the lateral view. The ends of the flat tube 5 are received in a collector and/or distributor for the refrigerant under high pressure, which are arranged in the interior of the inner cylinder 3. The collectors and/or distributors for the refrigerant under high pressure extend upwards in direction of the cylinder axis and penetrate the cover 6, which closes the outer cylinder 2. Exterior to the cover 6 the connections for the high-pressure inlet 9 and the high-pressure outlet 10 are formed connectable advantageously by flange connection for the connection to the tubing system of the refrigerant plant.

A low-pressure inlet 7 for the refrigerant vapor under low pressure is also through the cover 6 and extends into interior space 17 defined by the inner cylinder 3 of the inner heat exchanger 1.

Figure 2:
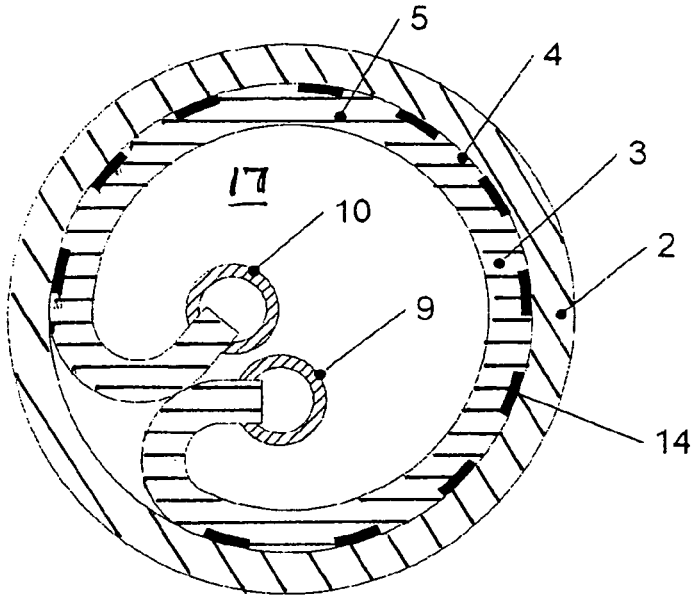
FIG. 2 is a sectional view of the inner heat exchanger and accumulator according to the principles of the present invention.

In FIG. 2 the inner heat exchanger with accumulator 1 of the invention is shown in a cross-sectional view. In the sectional view the cylinder layers are shown from outside to inside beginning with the outer cylinder 2 and the immediately followed by inner cylinder 3, which is preferably designed as flat tube 5 with microchannels 11 as mentioned above. Spacers 4 are formed as unitary parts of the flat tube 5, preferably at regular distances, and define channels 14 between the inner cylinder 3 and the outer cylinder 2. Vaporous refrigerant flows in the channels 14 between the cylinders 2, 3 from the low-pressure inlet 7 to the low-pressure outlet 8, whereby it is heated by the warmer refrigerant passing the microchannels 11 under high pressure, which thereby cools down.

Alternatively, the channels 14 can be formed by spacers 4 arranged between the inner cylinder 3 and the outer cylinder 2, whereby the spacers 4 need not necessarily be formed as unitary parts of the inner cylinder. It is equally advantageous to provide a single spacer 4 or a connected spacer 4 in a spacer framework, which create, or creates, a coaxial distance between the inner cylinder 3 and the outer cylinder 2, hence preferably creating the channels 14 required for the refrigerant vapor flow.

Figure 5:
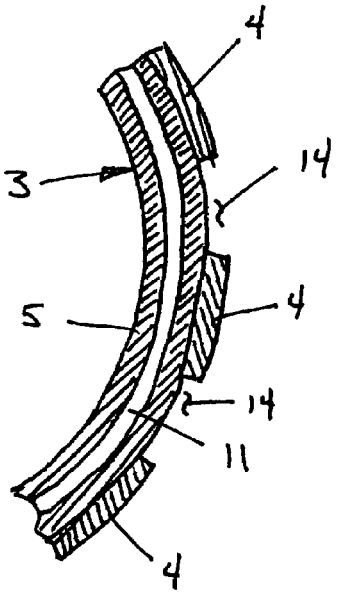
FIG. 5 is an enlarged sectional view of the flat tube with integrally formed spacers.
Figure 6:
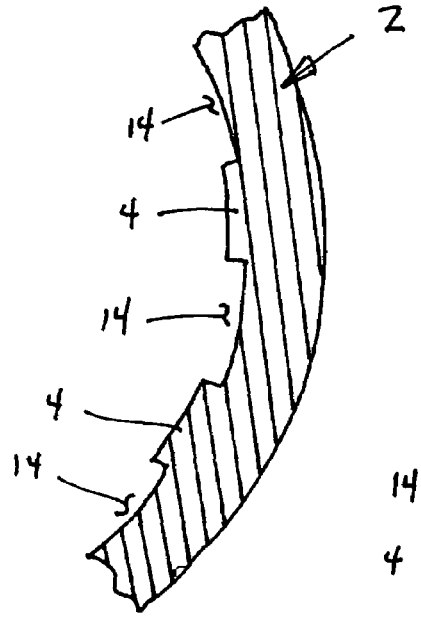
FIG. 6 is an enlarged sectional view of the outer cylinder with unitarily formed spacers.
Figure 7:
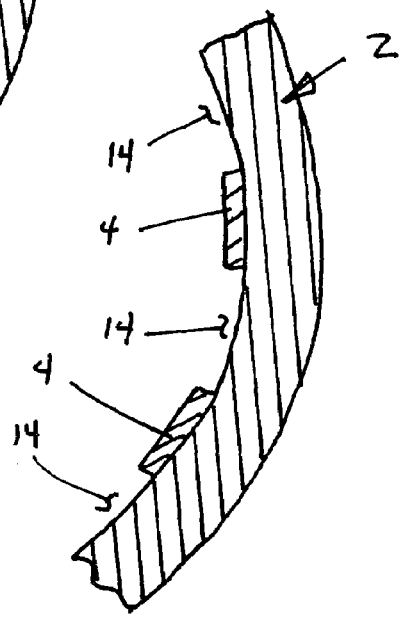
FIG. 7 is an enlarged sectional view of the outer cylinder with integrally formed spacers.

As such and as seen in FIGS. 5-7 the spacers 4 may be integrally formed with the inner cylinder 3 or unitarily or integrally formed with the outer cylinder 2.

The flat tube 5 is, at its ends, bent and connected such that the inner cylinder 3, with a closed cylinder surface, is created. The lower limitation of the inner cylinder 3 is produced by a bottom 20, whereby a collecting space develops for the liquid refrigerant from the low-pressure flow, which has not yet completely been vaporized.

Further shown in detail in FIG. 2, the advantageous arrangement of the ends of the flat tube 5 is represented. The ends of the flat tube 5 are taken each by a collector or distributor 9, 10, respectively, arranged in the interior space formed by the inner cylinder 3. Refrigerant under high pressure flows through the collector and distributor 9, 10, which are preferably designed as circular cylindrical tubes with passages for the flat tube 5 made along the generatrix of the tubes, extending in axial direction of the cylinder.

Figure 3:
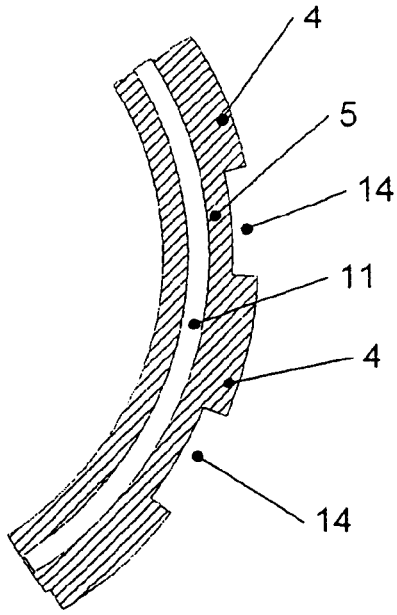
FIG. 3 is an enlarged sectional view of the flat tube with unitarily formed spacers and microchannels.

FIG. 3 shows the inner cylinder 3 of the invention, or a sector of the flat tube 5, with the spacers 4 and microchannels 11. A microchannel 11 is represented unhatched as an annulus segment in the figure. As has been mentioned, a particularly advantageous embodiment of the invention is that the spacers 4 are formed as a unitary or integral part of the flat tube 5.

According to the shown embodiment, the spacers 4 are formed along the generatrix of the inner cylinder 3 and the outer cylinder 2. A line running parallel to the cylinder axis is meant to be the generatrix. In an advantageous modification of this embodiment, the spacers 4 are formed helically along the cylinder surface inclined in axial direction of the outer and inner cylinders 2, 3. This results in a prolonged residence time of the refrigerant vapor in the interior of the heat exchanger 1. Hereby the refrigerant vapor is led spirally between the inner and outer cylinders 3, 2.

Figure 4A:
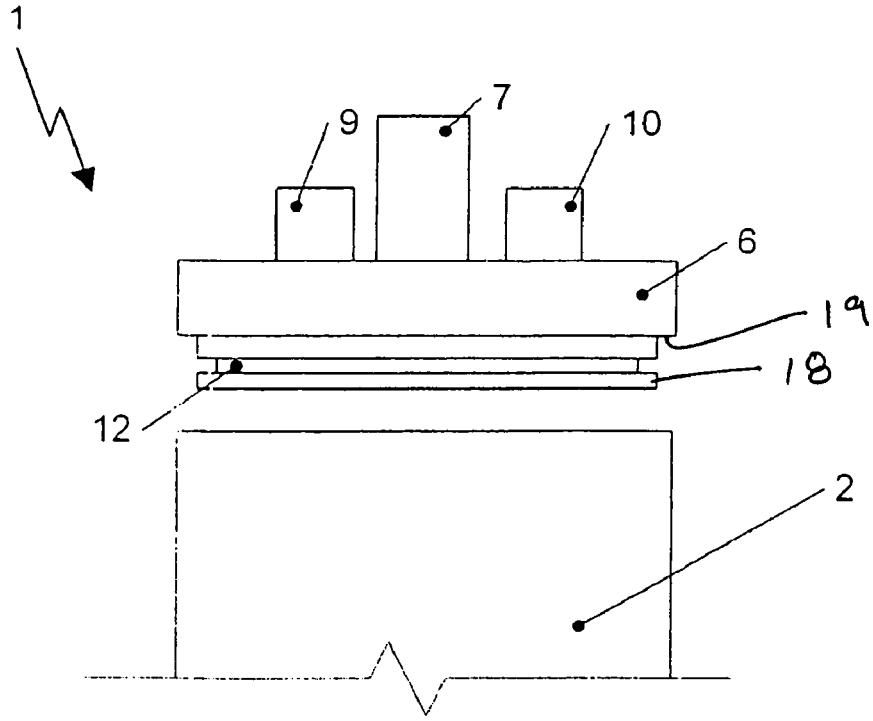
FIG. 4*a* is a side view of the outer cylinder and cover before assembly.
Figure 4B:
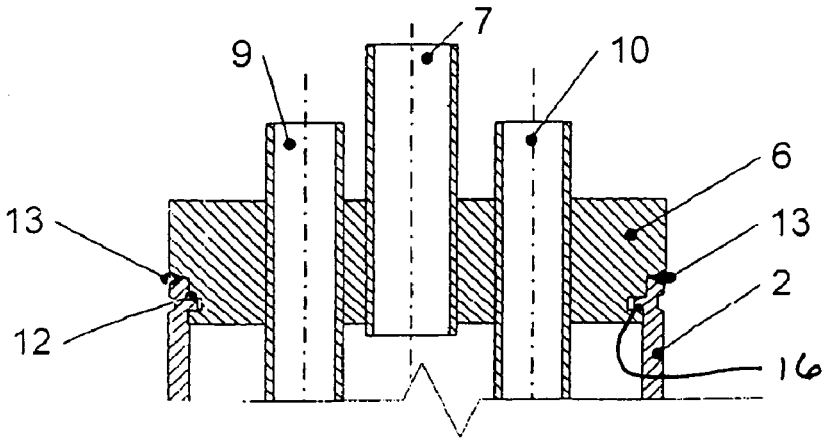
FIG. 4*b* is a sectional view of the outer cylinder and cover after assembly.

FIGS. 4*a* and 4*b* show the connection of a cover 6 to the outer cylinder 2. The cover 6 has a groove 12 formed in an extension 18 there off of. The outer cylinder 2 is received over the extension 18 and the groove 12 up to a stop 19. A section 16 of the upper part of the outer cylinder 2 protrudes into the groove 12 and may be made by a forming process such as rollforming, staking or other method, that produces a positive connection between outer cylinder 2 and cover 6. This design is particularly advantageous in that said connection can be manufactured very economically and has a high degree of tightness.

In the cover 6 the connections for the high-pressure inlet 9 and the high-pressure outlet 10 and the low-pressure inlet 7 are provided as well.

As specifically seen in FIG. 4*b*, the outer cylinder 2, with the cover 6 attached, is shown. The outer cylinder 2 is positively connected to the cover 6 through the section 16 protruding into the groove 12 of the cover 6. Additionally, a weld 13, generally parallel to the groove 12, is formed between the end of the outer cylinder 2 and the cover 6, generally at the stop 19, forming a tight connection between cover 6 and outer cylinder 2 is made. Thereby it is advantageous that the weld 13 makes possible an efficient termination of the interior of the inner heat exchanger with accumulator 1.

It is a particularly advantage of the embodiment according to the invention that the combination of flat tube 5 and microchannels 11 as inner cylinder 3 enables one to construct an apparatus that fulfils the specific requirements of the use of high-pressure refrigerants in air conditioning units. The manufacture of heat exchangers for high-pressure refrigerants is made possible economically favorable and technologically very well and tightly realizable by the use of face-side limiting refrigerant collecting and distributing tubes.

As any person skilled in the art will recognize from the previous detailed description and from the figures and claims, modifications and changes can be made to the preferred embodiments of the invention without departing from the scope of this invention defined in the following claims.

The invention claimed is:

1. An inner heat exchanger for high-pressure refrigerant with accumulator comprising:

an outer cylinder having an inner cylinder arranged therein, said inner cylinder being formed from a flat sheet with microchannels formed therein for refrigerant under high pressure, opposing ends of said flat sheet being bent into proximity with one another to form a generally cylindrical shape to form said inner cylinder, said opposing ends of said flat sheet remainig unconnected with one another, wherein liquid refrigerant under low pressure can be collected in said inner cylinder, and vaporous refrigerant under low pressure can flow between said inner cylinder and said outer cylinder in a plurality of channels provided therebetween, the vaporous refrigerant flowing from a low-pressure inlet located in one end of said heat exchanger to a low-pressure outlet located in another end of said heat exchanger.

2. An inner heat exchanger according to claim 1 wherein said channels are formed by spacers disposed between said inner cylinder and said outer cylinder.

3. An inner heat exchanger according to claim 2 wherein said spacers are formed as unitary parts of said inner cylinder.

4. An inner heat exchanger according to claim 2 wherein said spacers are formed as unitary parts of said outer cylinder.

5. An inner heat exchanger according to claim 2 wherein said spacers are formed along the generatrix of said inner cylinder and said outer cylinder.

6. An inner heat exchanger according to claim 2 wherein said spacers are formed helically along the outer surface of said inner cylinder and lead to a prolonged residence time of the refrigerant vapor in the interior of said heat exchanger.

7. An inner heat exchanger according to claim 2 wherein said spacers are formed helically along the inner surface of said outer cylinder and lead to a prolonged residence time of the refrigerant vapor in the interior of said heat exchanger.

8. An inner heat exchanger according to claim 2 wherein said spacers and inner cylinder are a unitary extrusion.

9. An inner heat exchanger according to claim 1 wherein said microchannels are oriented transverse to a cylinder axis defined by said inner cylinder.

10. An inner heat exchanger according to claim 1 further comprising a cover attached to one end of said outer cylinder, whereby said cover is provided with said low-pressure inlet, a high-pressure inlet and a high-pressure outlet.

11. An inner heat exchanger according to claim 10 wherein said cover is provided with an extension having a groove defined therein, said extension and said groove being received within said outer cylinder, a portion of said outer cylinder extending into said groove forming a positive engagement between said outer cylinder and said cover.

12. An inner heat exchanger according to claim 11 wherein a weld is provided between said outer cylinder and said cover.

13. An inner heat exchanger according to claim 12 wherein said weld is generally parallel to said groove.

14. An inner heat exchanger according to claim 1 wherein said opposing ends of said flat sheet are received within a distributor and a collector, interiors of which are in fluid communication with said microchannels.

* * * * *